United States Patent [19]

Teratsuji et al.

[11] Patent Number: 5,058,219

[45] Date of Patent: Oct. 22, 1991

[54] CIRCULATING WATER POOL

[75] Inventors: Osamu Teratsuji, Ichikawa; Keiichi Nishimura, Urawa; Yoshiro Moriya, Matsudo; Yukihiko Ueda, Yokohama, all of Japan

[73] Assignee: Ishikawajima-Harima Jukogyo Kabushiki Kaisha, Tokyo, Japan

[21] Appl. No.: 575,228

[22] Filed: Aug. 30, 1990

Related U.S. Application Data

[60] Division of Ser. No. 540,456, Jun. 18, 1990, Pat. No. 4,979,243, which is a continuation of Ser. No. 311,597, Feb. 15, 1989, abandoned.

[30] Foreign Application Priority Data

Aug. 22, 1988 [JP] Japan ..... 63-207939
Aug. 23, 1988 [JP] Japan ..... 63-209134

[51] Int. Cl.[5] ..... E04H 4/12
[52] U.S. Cl. ..... 4/488

[58] Field of Search ..... 4/488, 489, 491, 492, 4/496

[56] References Cited

FOREIGN PATENT DOCUMENTS 2222594 11/1973 Fed. Rep. of Germany ..... 4/488
2237800 2/1974 Fed. Rep. of Germany ..... 4/497
63-51571 3/1988 Japan ..... 4/488

*Primary Examiner*—Charles E. Phillips

[57] ABSTRACT

A diverging section is defined in a lower water passage such that the outlet or downstream end of the diverging section becomes substantially equal to the width of a front curved water passage and to the height of an upper water passage and/or one or more guide vanes are disposed within the front curved water passage such that the outlet of each of water passages defined by the adjacent guide vanes is larger in size than the inlet thereof while the intermediate section of each passage is more enlarged in size than both the inlet and the outlet thereof.

1 Claim, 6 Drawing Sheets

CIRCULATING WATER POOL

This is a division of application Ser. No. 07/540,456, filed June 18, 1990 now U.S. Pat. No. 4,979,243, which is a continuation of application Ser. No. 07/311,597 filed Feb. 15, 1989 now abandoned.

BACKGROUND OF THE INVENTION

The present invention relates to a circulating water pool which can be used as a pool for learning how to swim and for intensified training of swimming players on the advice of an instructor or the like or as model testing tank for investingating and measuring various hydrodynamic factors of ship and off-structure models.

Scientific and efficient methods have been recently employed in swimming training. There have been proposed and demonstrated some circulating water type pools in which a device for flowing water is disposed in a vertical type circulating water passage having an observation window portion so that one can observe and advice a beginner who wants to learn how to swim and a trainee.

FIG. 1 illustrates one example of the conventional circulating water pools. A vertical circulating water pool main body 1 which is mounted on a foundation 2 comprises an upper water passage 3, a lower water passage and front and rear curved portions 5 and 6 which deflect the direction of the water flow and intercommunicate between the upper and lower water passage 3 and 4. A side wall of the pool main body 1 has a plurality of observation windows 7 along the upper water passage 3 which is opened upwardly and has a free water surface, whereby an observation section is defined. An impeller 9 for producing the water flow circulating the upper and lower water passage 3 and 4 is disposed in the lower water passage 4 in the vicinity of its upstream end or the rear curved water passage 6 and is driven by drive device 10 disposed outside of the pool main body 1. Furthermore, guide vanes 11 are securely disposed in the front and rear water flow deflection portion 5 and 6 in order to change the direction of the water flow.

When the impeller 9 is driven by the drive device 10, the water flow is produced and accelerated in the low water passage 4 and is changed in direction in the front curved portion 5 so as to enter the upper passage 3. Thereafter the water flow leaving the upper water passage 3 is again changed in direction by the rear curved portion 6 and sucked into the lower water passage 4 by the rotating impeller 9. Thus the water circulates through the pool main body 1.

In the conventional circulating water pool of the type described above, the front water flow deflection portion for changing the direction of the water flow flowing from the impeller has two square corners and short guide vanes 11 are disposed at each corner and spaced apart from each other by the same distance so that the water flow is forced to flow outwardly by the centrifugal force. In order to change such outwardly deflected water flow into the uniform water flow throughout the upper water passage 3 where the observation section 8 is located for instance as shown in FIG. 1, a pressure chamber 12 having a three-dimensionally curved surfaces is formed at the upstream end of the upper water passage 3 and a nozzle-shaped portion extending upwardly from the upper surface of the pressure chamber 12 is communicated with a vacuum pump 13 to suck water so that no free water surface exists in the pressure chamber 12.

However, when the circulating water pool is arranged in the manner described above, a part of the upper water passage 3 along the length of the observation section 8 has a free water surface in contact with the surrounding atmosphere so that the pressure between the water flow having a free water surface and the water in the pressure chamber 12 becomes discontinuous, resulting in the standing or stationary waves produced in the upper water passage 3 along the observation section 8. Such standing or stationary waves, which are a fatal defect in the circulating water pools, must be decreased by disposing a wave-supressing plate 14 at the upstream end of the observation section 8. Then, because of the upwardly extending nozzle portion of the pressure chamber 12 and the wave-suppressing plate 14, a boundary layer generates to cause the flow rate drops by about 20% along the observation section 8. In order to compensate the decrease in flow rate, a surface accelerating device 15 must be disposed between the pressure chamber 12 and the wave-suppressing plate 14. As described above, in order to decrease the standing or stationary waves and to make the water flow uniform along the observation section 8 in the upper passage 3, the conventional circulating water pools must be provided with various complicated devices.

In order to solve the above-described problems, a circulating water pool as shown in FIG. 2 has been devise and demonstrated. The front and rear ends of the pool main body 1 are curved to define the curved water passages 5 and 6 and a round bulged portion 36 is formed at the upstream end of the bottom 3' of the upper water passage 3 so as to prevent the separation of the water flow passed through the front curved portion 5.

In the case of the circulation water pool with such curved water passages 5 and 6, the bulged portion 36 is effective to some extent to prevent the water flow separation; but a step is inevitably formed between the bulged portion 36 and the flat bottom 3' so that the reversal of the water flow results. Furthermore, because of variations in depth, the standing or stationary waves are produced over a free water surface or the uniform water flow through the section of the upper water passage 3 along the observation section 8 is considerably adversely affected.

The present invention was made to substantially solve the above and other problems encountered in the conventional circulating water pool and becomes more apparent from the following description of some preferred embodiments thereof taken in conjunction with the accompanying drawings.

BRIEF DESCRIPTION OF THE DRAWINGS

Same reference numerals are used to designate similar parts throughout the figures.

DETAILED DESCRIPTION OF THE PREFERRED EMBODIMENTS

Figure 1:
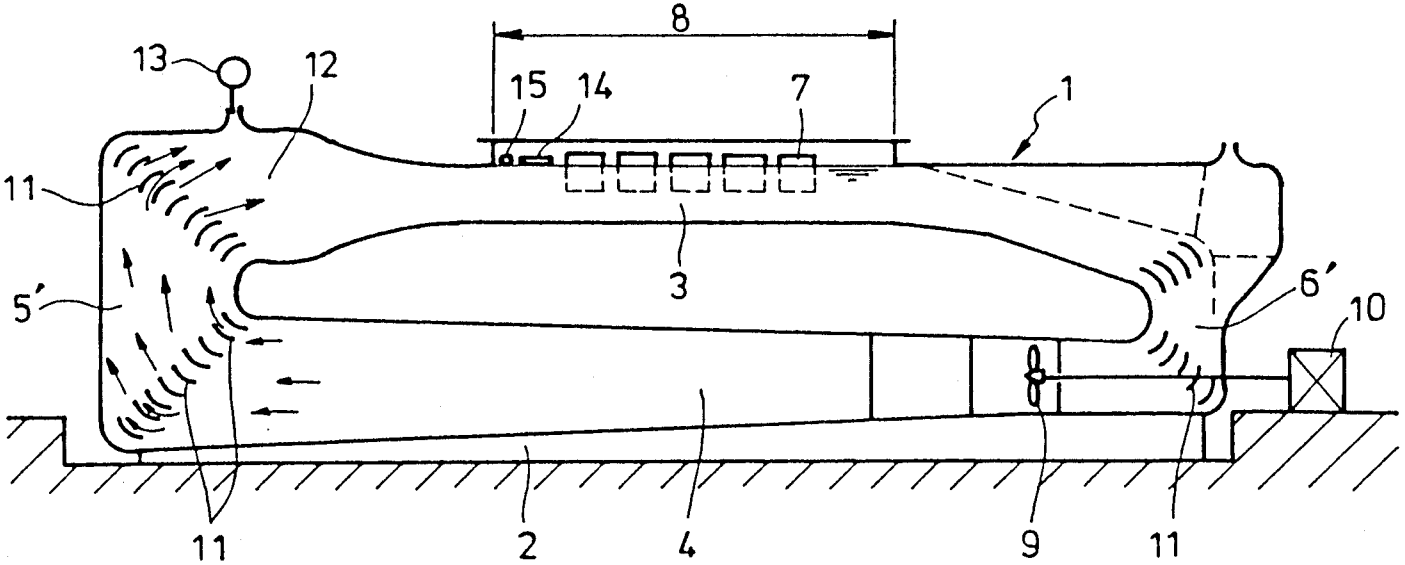
Fig. 1 PRIOR ART
FIG. 1 is a side sectional view of a conventional circulating water pool.
Figure 2:
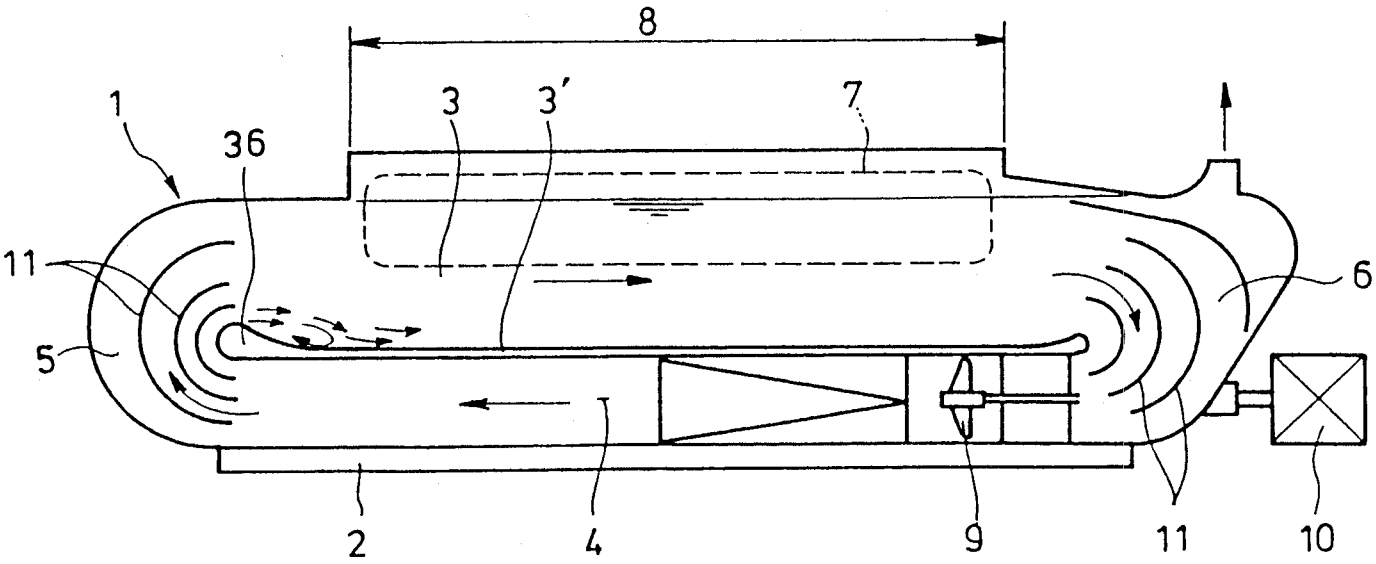
Fig. 2 PRIOR ART
FIG. 2 is a side sectional view of another conventional circulating water pool.
Figure 3:
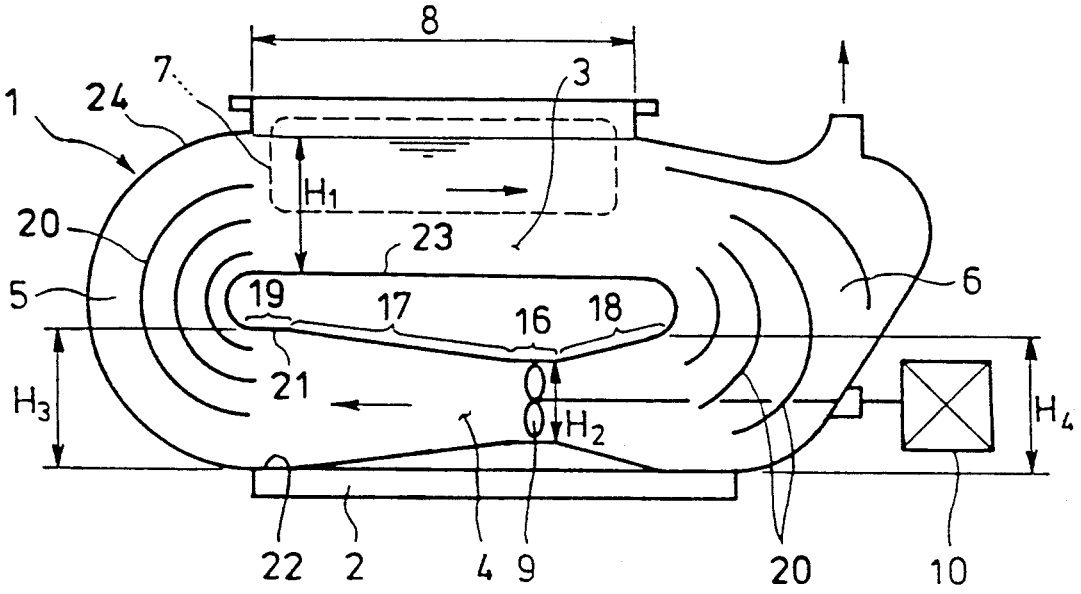
FIG. 3 is a side sectional view of a first embodiment of the present invention.
Figure 4:
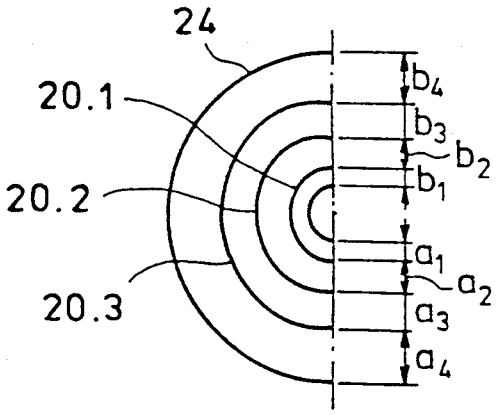
FIG. 4 is a detailed view illustrating the arrangement of the wave guides shown in FIG. 3.

Now referring to FIGS. 3 and 4, the first embodiment of the present invention will be described in detail.

The height $H_1$ of the upper water passage 3 is equal to the width of the front and rear curved water passages 5 and 6 and an intermediate portion between the ends of the lower water passage 4 is decreased in height to define a straight pipe section 16 with height $H_2$. Thus, downstream of the straight pipe section 16 is defined a diverging section 17 which is symmetrical with respect to the axis of the lower water passage 4 in the vertical direction while upstream of the straight pipe section 16 is defined a converging section 18 which is symmetrical about the axis of the lower water passage 4 in the vertical direction. Height $H_3$ of the diverging section 17 and height $H_4$ of the inlet of the converging section 18 are substantially equal to the height $H_1$ of the upper water passage 3. The outlet of the diverging section 17 may be in the form of a straight pipe section with $H_3$ in height.

For instance, three impellers 9 are disposed in parallel with each other in the straight pipe section 16 and are driven by the drive devices 10.

Within the front and rear curved water passages 5 and 6, a plurality of guide vanes 20 are disposed such that the distance between the adjacent guide vanes is increased as the guide vanes 20 are disposed radially outwardly. Furthermore, the following conditions must be satisfied:

$a_1 = b_1$ $a_2 = b_2$ $a_3 = b_3$ and $a_4 = b_4$, where

- $a_1$: the distance between the upper plate 21 of the straight pipe section 19 and the first guide vane 20.1;
- $a_2$: the distance on the inlet side between the first guide vane 20.1 and the second guide vane 20.2;
- $a_3$: the distance on the inlet side between the second guide vane 20.2 and the third guide vane 20.3;
- $a_4$: the distance between the third guide vane 20.3 and the bottom plate 22 of the straight pipe section 19;
- $b_1$: the distance between the bottom plate 23 of the upper water passage 3 and the first guide vane 20.1;
- $b_2$: the distance on the outlet side between the first and second guide vanes 20.1 and 20.2;
- $b_3$: the distance on the outlet side between the second and third guide vanes 20.2 and 20.3; and
- $b_4$: the distance between the third guide vane 20.3 and the outer plate 24 of the upper water passage 3.

In the first embodiment with the above-described construction, when each small-diameter impeller 9 is driven by the driving device 10, the water in the converging section 18 flows into the diverging section 17 in the lower water passage 4 and in the diverging section 17, the height of the water flow is uniformly increased and the height $H_3$ at the outlet of the diverging section and the straight pipe section 19 becomes equal to the distance of the curved water passage 5 and the height $H_1$ of the upper water passage 3.

The distances between the guide vanes 20.1, 20.2 and 20.3 in the curved water passage 5 following or succeeding to the diverging section 17 and the straight pope section 19 maintain the same distance between the adjacent guide vanes from the starts to the ends of their curvatures, respectively, they can prevent the separation of the water flow in each curved portion within the curved water passage 5 so that the head losses in respective curved passages become substantially equal to each other, resulting in the water flow passing through the upper water passage 3 having a uniform flow rate distribution in the direction of the height in the water passage 3.

The water in the upper passage 3 substantially uniformly flows into the rear curved water passage 6 and then into the converging section 18 and is forced to flow by a small drive force of each small-diameter impeller 9.

Figure 5:
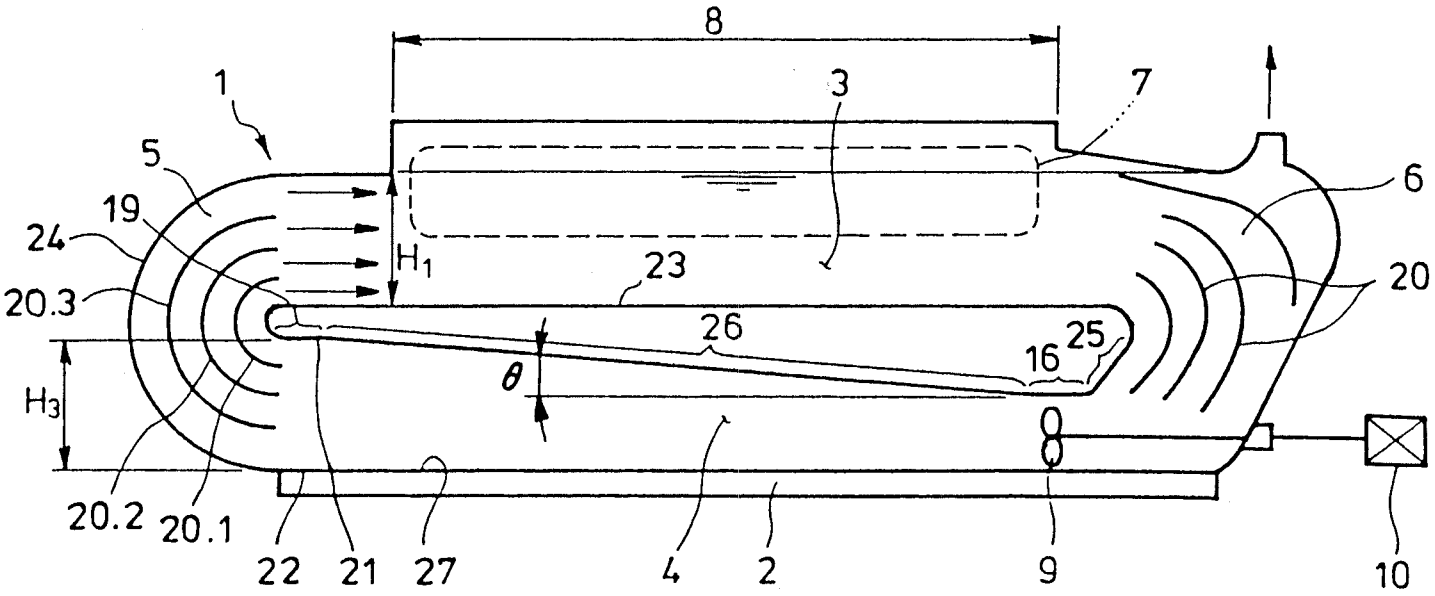
FIG. 5 is a side sectional view of a modification of the first embodiment.

FIG. 5 illustrates a modification of the first embodiment which is substantially similar in construction to that of the first embodiment except that the starting end portion of the lower water passage 4 is reduced to define a diverging section 25 and the straight pipe section 16 as well as a diverging section 26 only whose upper surface is tapered such that the height of the diverging section 26 is continuously increased from the inlet end to the outlet end. It is preferable that the tapered angle or diverging angle is within 6. A straight pipe section 19 is defined at the outlet portion of the diverging section 26.

In this modification, the diverging section 26 with the height increased only in the upward direction from the inlet end to the outlet end causes, the height of the water flow to be increased. While separation of the water flow is prevented by the guide vanes 20.1, 20.2 and 20.3, the water flow flows into the upper passage 3 at substantially equal head losses. As a result, the water flow passing through the upper water passage 3 has a uniform flow rate distribution in the direction of the height of the upper water passage 3. Especially since the bottom plate 27 of the diverging section 26 is horizontal, the water flow passing through the upper water passage 3 has a more uniform flow rate distribution.

As described above, in the case of the first embodiment and its modification, the diverging section is defined from the upstream side to the downstream side of the lower water passage and the height at the outlet end of the diverging section is made equal to the width of the front curved water passage and the upper water passage so that the standing or stationary waves can be suppressed; the separation of the water flow in the front curved water passage can be prevented, thereby making the head losses of the water flow in the front curved water passage substantially equal; and therefore the uniform flow rate distribution can be obtained in the upper water passage. Furthermore, the means for producing the water flow are disposed in the straight pipe section in the vicinity of the inlet end of the diverging section so that they can be made compact in size and the cost for driving them can be reduced to a minimum.

Figure 6:
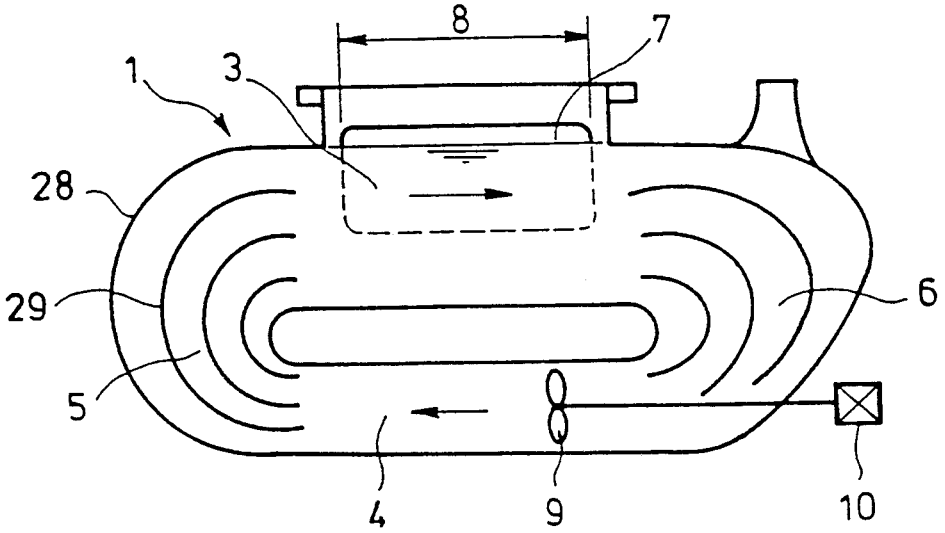
FIG. 6 is a side sectional view of a second embodiment of the present invention.
Figure 7:
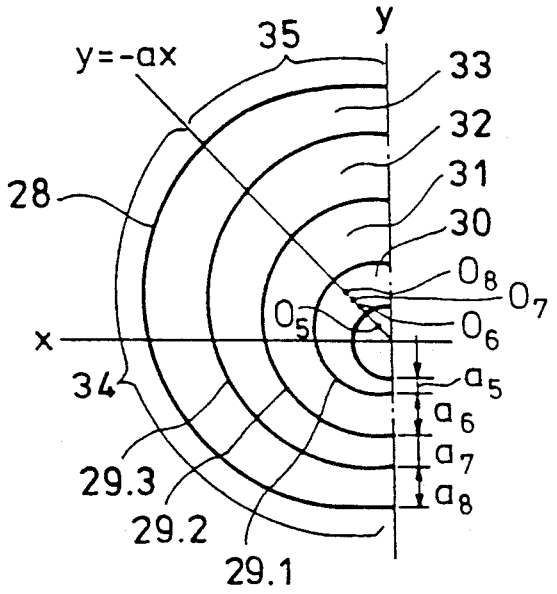
FIG. 7 is a detailed view illustrating the arrangement of wave guides shown in FIG. 6.

Next referring to FIGS. 6-8, a second embodiment of the present invention will be described.

When the upper water passage 3 is for instance about 2 m in width and about 1 m in depth (height) in application of the upper water passage as a swimming course and when the lower water passage 4 is for instance about 2 m in width and about $\frac{1}{3}$ thereof, that is, about 666 mm in height, the operation of the circulating water pool can be carried out efficiently only by three small-diameter impellers 9.

Center of curvature $0_8$ of the front curved plate 28 which is arcuated in side cross section and defines the front curved water passage 5 is located in the second quardrant of the coordinate system in which the line interconnecting the outlet and inlet ends of the front curved water passage 5 is defined as Y-axis while the boundary centerline between the upper and low water passages 3 and 4 is defined as the X-axis. The straight line connecting the center of curvature $0_8$ with the intersection (the origin) between the X- and Y-axes is expressed by $$y = -ax \text{ (where } x<0).$$

Within the front curved water passage 5, the guide vanes 29.1, 29.2 and 29.3 each having an arcuate cross sectional configuration in the side sectional view are located at their predetermined positions. More specifically, the outer guide vane of the adjacent guide vanes is gradually spaced apart from the inner guide vane such that the distance between them at the outlet of the water passage defined by them becomes wider than that at the inlet. In addition, centers $0_5$, $0_6$ and $0_7$ of the curvature of the guide vanes 29.1, 29.2 and 29.3 must be positioned on the straight line which connects the origin with the center $0_8$ and is expressed by $y=-ax$ as described above.

Furthermore, the inlet portion and the outlet portion of each of the guide vanes 29.1, 29.2 and 29.3 are made horizontal within a predetermined range or section so that a degree of linearity of the water flow can be increased.

Figure 8:
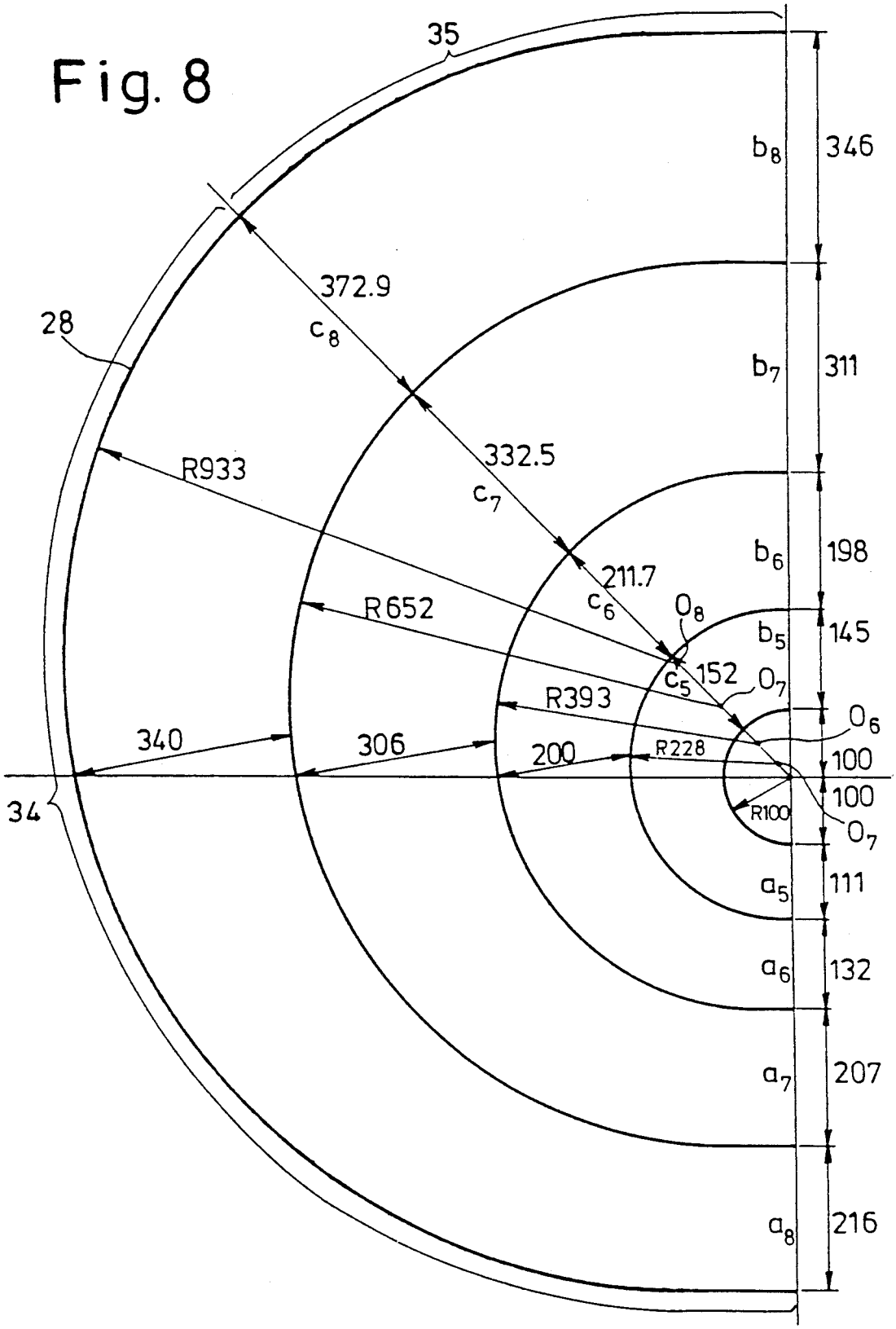
FIG. 8 is a detailed view illustrating a practical arrangement of the wave guides shown in FIG. 7.

More specifically, inside the side plate of the front curved water passage 5, the arcuate guide vanes 29.1, 29.2 and 29.3 each made of a sheet of metal such as stainless steel are disposed according to the sizes or dimensions as shown in FIG. 8 and securely welded.

In this preferred embodiment with above-described construction, when the impellers 9 which are disposed in the lower passage 4 which is lower in height than the upper water passage 3 are driven by the drive devices 10, the water in the lower water passage 4 is forced to flow into the front curved water passage 5 and then into the water passages 30, 31, 32 and 33 defined by the guide vanes 29.1, 29.2 and 29.3.

The respective water passages 30, 31, 32 and 33 are gradually increased in size from the sizes $a_5$, $a_6$, $a_7$ and $a_8$, respectively, and are most enlarged at the potions $c_5$, $c_6$, $c_7$ and $c_8$ where the passages 30, 31, 32, and 33 cross the straight line $y=-ax$ and then gradually reduced so that the sizes of the outlet of the passage 30, 31, 32 and 33 become $b_5$, $b_6$, $b_7$ and $b_8$.

It follows therefore that the flow rates of the water flows flowing through the inlet with the sizes $a_5$, $a_6$, $a_7$ and $a_8$ into the passages 30, 31, 32 and 33 are slightly decreased as the passages 30, 31, 32 and 33 are enlarged in an enlarged zone 34 and at the same time, the separation of the water flows occur; but in a reducing zone 35, as the passages 30, 31, 32 and 33 are reduced in size, the water flows are compressed and the separation is eliminated so that the water flows flow out from the respective outlet with substantially equal head losses, whereby the water flows at a uniform flow rate pass through the upper water passage 3.

In this embodiment, the number of guide vanes may be one or more.

As described above, according to the circulating water pool of the second embodiment, the arcuate-section guide plates are disposed, within the front curved water passages, such that the distances between the adjacent guide vanes are gradually increased radially outwardly from the innermost passage to the outermost passage; the outlet of each passage is wider than its inlet; and the intermediate portion of each passage is larger in size than both the inlet and outlet. As a result, each passage defined by the adjacent guide vanes is gradually increased from its inlet, mostly enlarged at a predetermined portion and then gradually reduced toward the outlet so that in the front curved water passage, the separation of the water flows can be prevented and therefore the water flow flowing through the upper passage has a uniformed flow rate distribution. The height of the lower water passage can be made lower than that of the upper water passage so that the impellers can be made compact in size and the operation cost can be remarkably reduced to a minimum. In addition, the pressure chamber, the vacuum pump, the wave suppressing plate, the surface accelerating device, etc. which are required in the conventional circulating water pools can be eliminated. Moreover, the whole water pool main body can be decreased in height and therefore the component parts and other devices can be made compact in size.

What is claimed is:

1. In a vertical type circulating water pool with a pool main body having an upper water passage having an observation section, a lower water passage with means for producing water flow and front and rear curved water passages intercommunicating said upper and lower water passages, said front passage having an inner wall and an outer wall, an improvement comprising at least a plurality of arcuate guide vanes extending from an inlet to an outlet of said front curved water passage said at least a plurality of arcuate guide vanes in cooperation with the outer wall and the inner wall form a plurality of water channels, the distance between said guide vanes is increased radially outwardly from said inner wall to said outer wall and an outlet of each of the water channels is greater in size than an inlet thereof while an intermediate section is greater than said inlet or said outlet thereof.

* * * * *